US007204706B2

(12) United States Patent
Su et al.

(10) Patent No.: US 7,204,706 B2
(45) Date of Patent: Apr. 17, 2007

(54) ELECTRICAL CONNECTOR

(75) Inventors: Yi-Chung Su, Tu-Chen (TW); Hsin Kuo Dai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/993,618

(22) Filed: Nov. 19, 2004

(65) Prior Publication Data

US 2005/0112918 A1 May 26, 2005

(30) Foreign Application Priority Data

Nov. 21, 2003 (TW) ..... 92220592 U

(51) Int. Cl.
*H01R 29/00* (2006.01)

(52) U.S. Cl. ..... 439/188; 439/79

(58) Field of Classification Search ..... 439/79, 439/188, 607; 200/51.1
See application file for complete search history.

(56) References Cited

U.S. PATENT DOCUMENTS 4,633,048 A * 12/1986 Komatsu ..... 200/51.1
4,797,114 A * 1/1989 Lau ..... 439/79
5,693,924 A 12/1997 Fetterolf, Sr. et al.

* cited by examiner

*Primary Examiner*—Javaid H. Nasri
(74) *Attorney, Agent, or Firm*—Wei Te Chung

(57) ABSTRACT

An electrical connector (1) used in high frequency signal transmission filed includes an insulative housing (2), an immovable contact (5) retained in the housing. The immovable contact includes a main body (50), a cantilevered arm (51) longitudinally extending from the main body, a soldering portion (53) backwardly extending from the main body. The cantilevered arm forms an angle to the main body. The main body is a substantially "Z" shape to prolong the current path of the immovable contact and to cut the area of the immovable contact, thereby decreasing the capacity of the immovable contact.

15 Claims, 6 Drawing Sheets

ELECTRICAL CONNECTOR

BACKGROUND OF THE INVENTION

1. Field of the Invention

This invention generally relates to an electrical connector and more particularly, to an electrical connector used in high frequency signal transmission.

2. Description of the Prior Art

In high frequency transmission field, an increased demand of high transmission performance is needed. FIG. 1 shows a plan view of a contact 6 used in a conventional electrical connector. The contact 6 includes a main body 8, a cantilevered beam 7 longitudinally extending from the main body 8, a soldering portion 9 backwardly extending from the main body 8. The main body 8 is substantially rectangular shaped. As a result, the current path is relatively short when the current goes through the contact. Therefore, the capacity of the contact is relatively high to impair the transmission performance of the conventional electrical connector.

Hence, an improved electrical connector is desired to overcome the above problems and meet the increasing transmission demand.

BRIEF SUMMARY OF THE INVENTION

It is an object of the present invention to provide an electrical connector with good electrical characteristics.

In order to attain the object above, an electrical connector used in the high frequency transmission field according to the present invention includes an insulative housing, an immovable contact retained in the housing. The immovable contact includes a main body, a cantilevered arm longitudinally extending from the fixing portion, a soldering portion backwardly extending from the main body. The cantilevered arm forms an angle with the main body. The main body is a substantially "Z" shape which is in favor of prolonging the current route when the current goes through the immovable contact. Therefore the capacity of the immovable contact will decrease and improve the transmission preference of the electrical connector in high frequency signal transmission.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
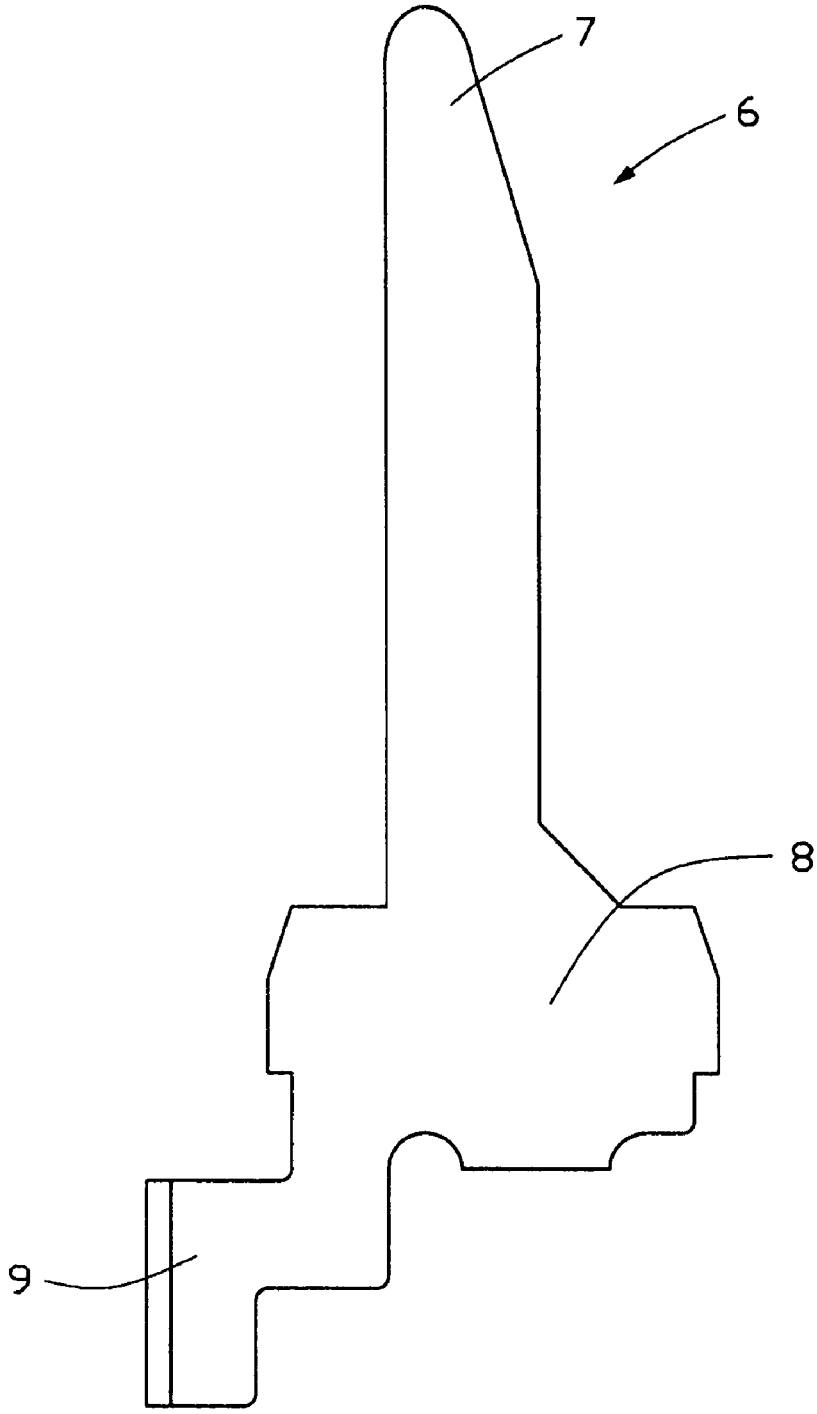
FIG. 1 (PRIOR ART)
FIG. 1 is a plan view of an immovable contact of an electrical connector according to a prior art.
Figure 2:
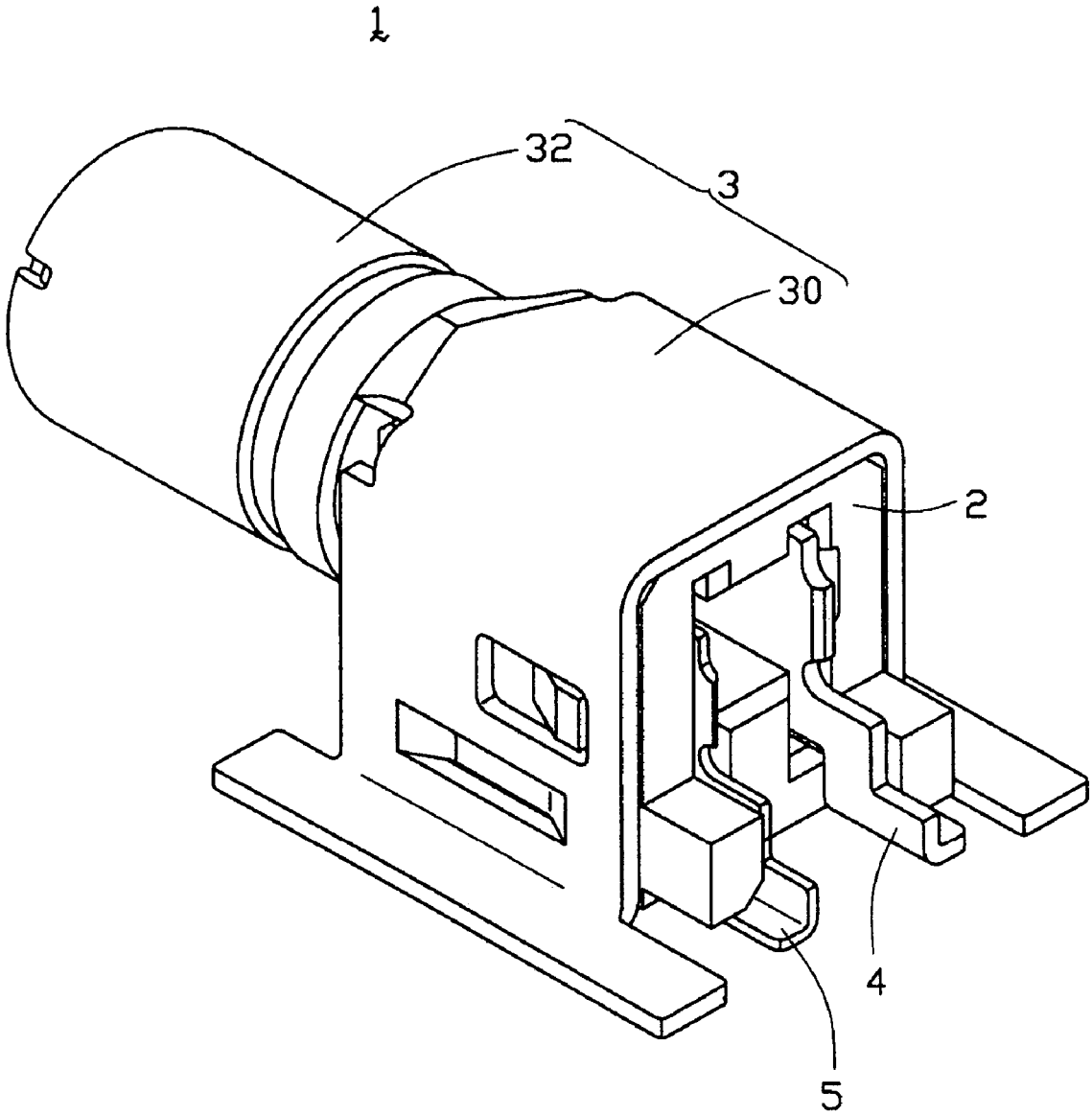
FIG. 2 is an assembled view of an electrical connector according to the present invention.
Figure 3:
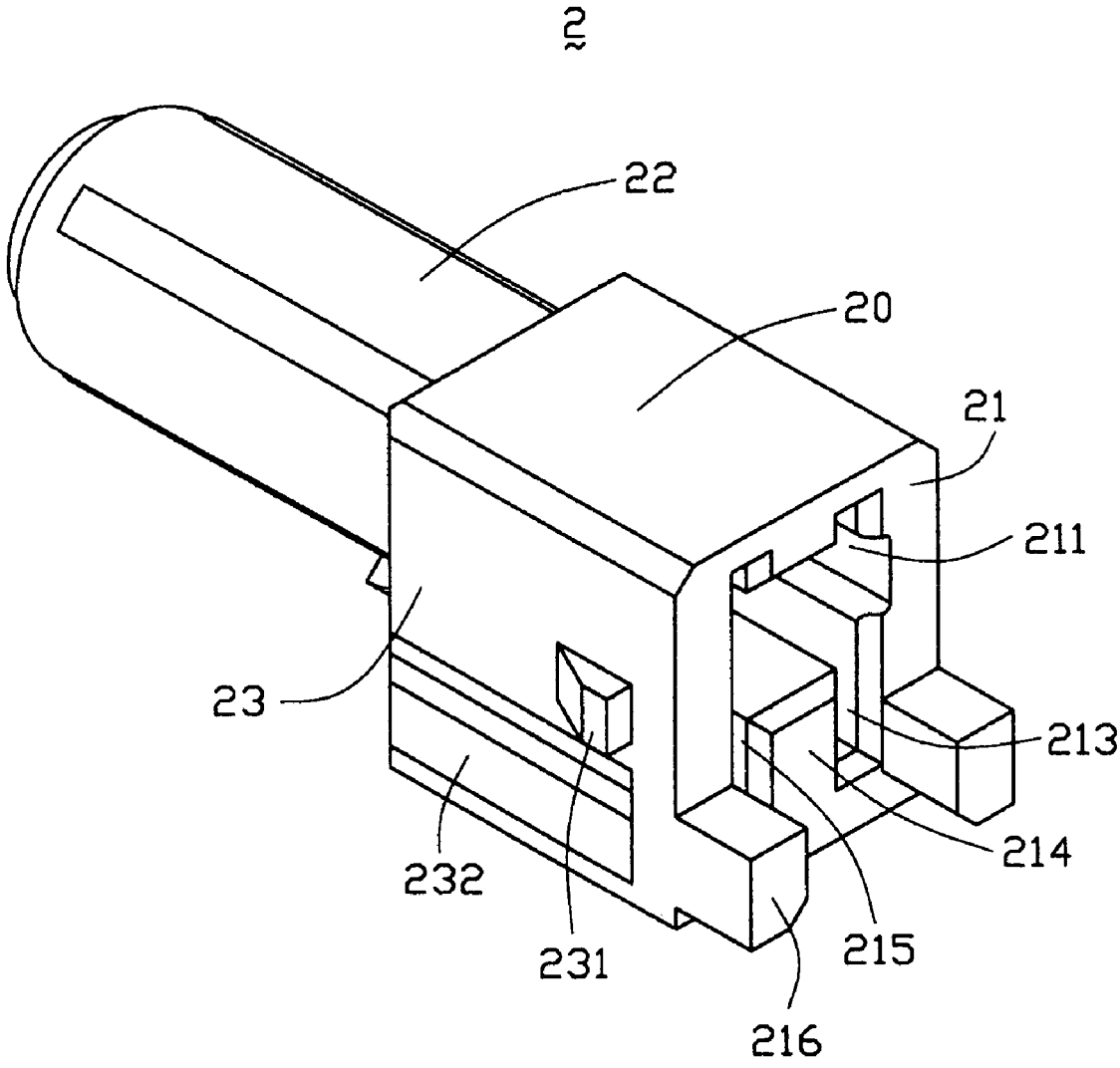
FIG. 3 is a perspective view of a housing of the electrical connector showing in FIG. 2.

As shown in FIGS. 2–3, an electrical connector 1 adapted for mounting on a printed circuit board (not shown) according to the present invention includes an insulative housing 2, a metal outer shield 3 enclosing the housing 2, a movable contact 4 and an immovable contact 5 retained in the housing 2. The housing 2 includes a substantially cubic main body 20 and a generally columnar portion 22 forwardly extending from the main body 20.

As depicted in FIG. 3, the cubic main body 20 of the housing 2 comprises a back wall 21 and a pair of sidewalls 23. The back wall 21 defines a receiving cavity 211 thereof. A vertical partition 214 upwardly projects from a substantially middle of a bottom surface of the receiving cavity 211, thereby forming a first groove 213 for receiving the movable contact 4 and a second groove 215 for receiving the immovable contact 5. A pair of posts 216 backwardly extends from opposite sides of the back wall 21 for further resisting the movable contact 4 and the immovable contact 5, as will be more detailed hereinafter. Each sidewall 23 forms a protrusion 231 positioned in a back portion thereof adjacent to the back wall 21 and defines a channel 232 located in a bottom portion thereof.

Figure 4:
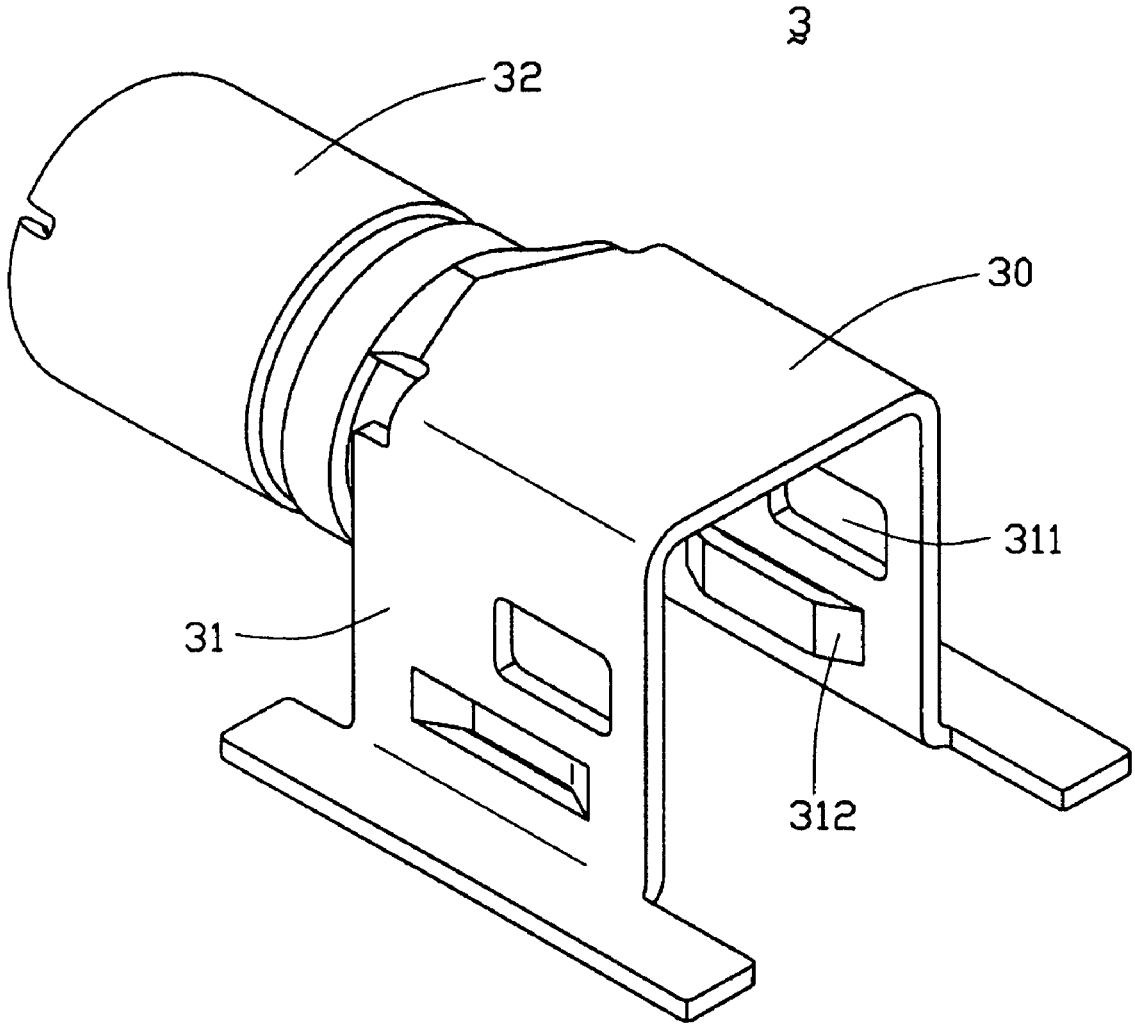
FIG. 4 is a perspective view of a shield of the electrical connector showing in FIG. 2.

Referring to in FIG. 4, the metal outer shield 3 is substantially similar to the insulative housing 2 in shape. The shield 3 includes a back portion 30 appropriately enclosing the cubic main body 20 of the housing 2 and a columnar front portion 32 preferably shielding the columnar front portion 22 of the housing 2. The back portion 30 includes a pair of sidewalls 31 each defining a notch 311 for appropriately exposing the protrusion 231 of the housing 2 and a projection 312 interiorly depressing for interferentially fixing with the channel 232 of the housing 2.

Figure 5:
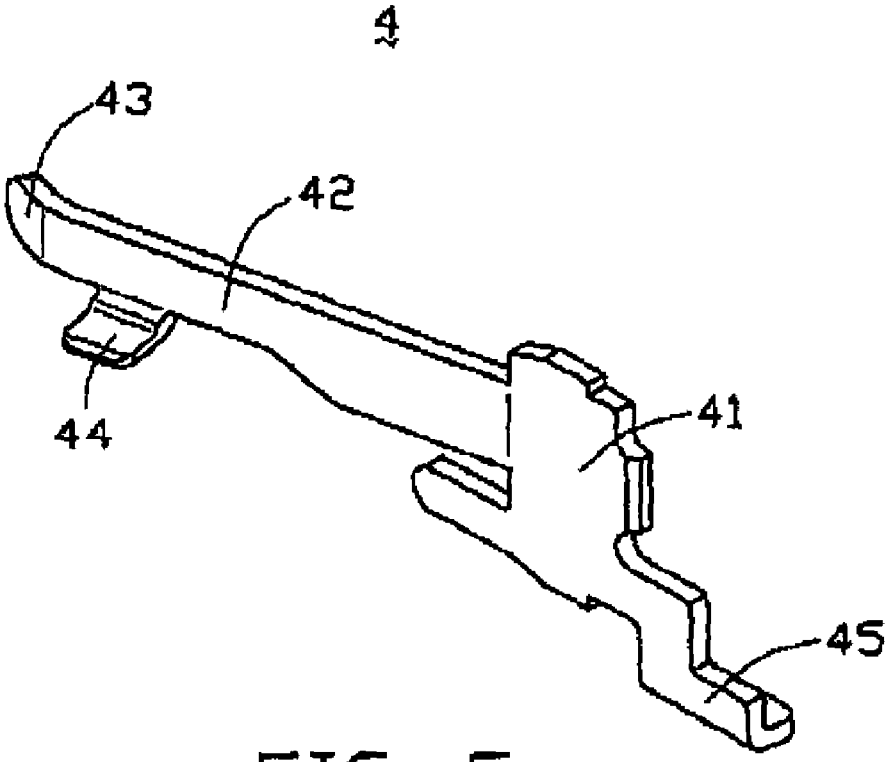
FIG. 5 is a perspective view of a movable contact of the electrical connector showing in FIG. 2.

Referring to FIG. 5, the movable contact 4 includes a fixing portion 41, a cantilevered beam 42 longitudinally extending from the fixing portion 41, a lead-in portion 43 formed in a free end of the cantilevered beam 42 for preferably engaging with a complementary connector (not shown), a step-shaped soldering portion 45 backwardly extending from the fixing portion 41. A tab 44 transversely extends from a front portion of the cantilevered beam 42.

Figure 6:
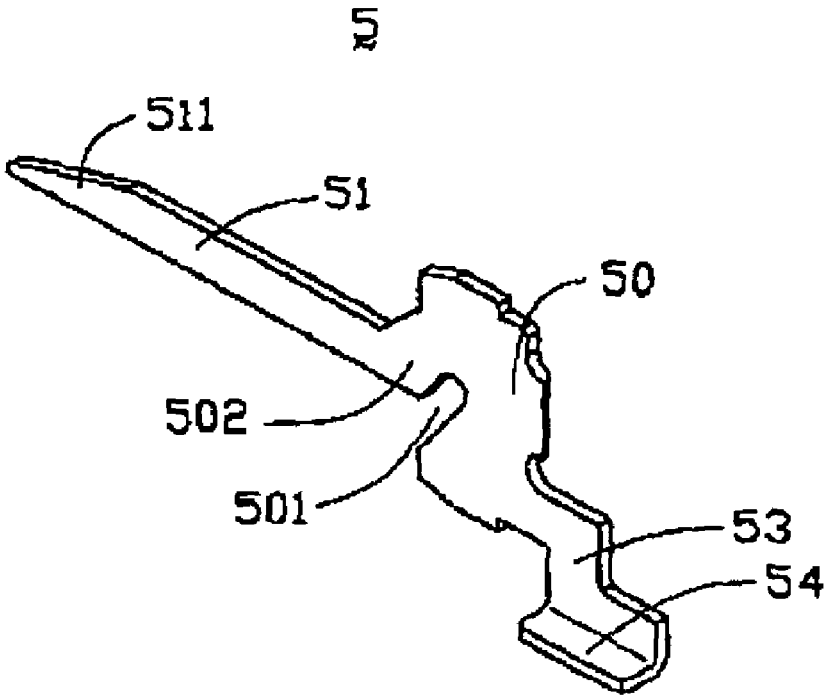
FIG. 6 is a perspective view of an immovable contact of the electrical connector showing in FIG. 2.
Figure 7:
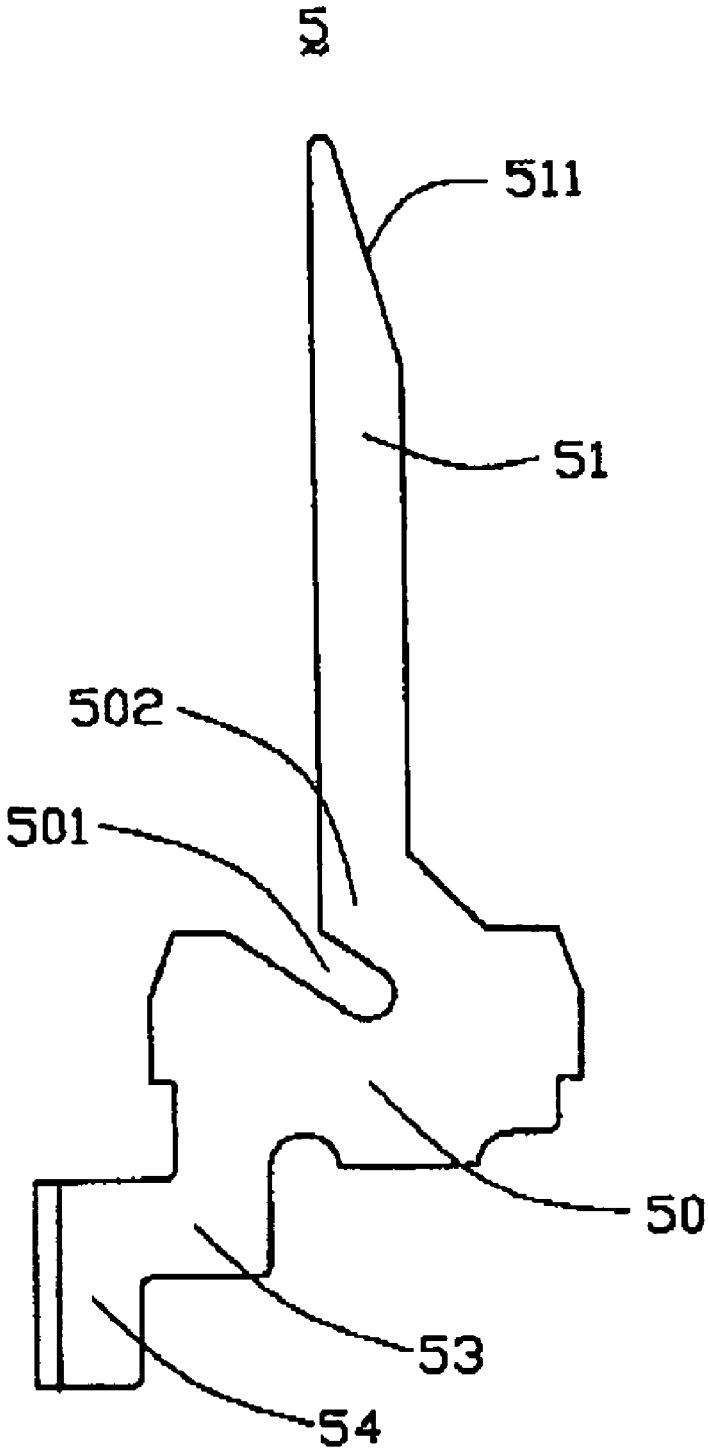
FIG. 7 is a plan view of the immovable contact of the electrical connector.

Referring to FIG. 6 in conjunction with FIG. 7, the immovable contact 5 includes a main body 50, a cantilevered arm 51 longitudinally extending from the main body 50, a right angle soldering portion 53 backwardly extending from the main body 50. The main body 50 defines a slot 501 to form an extension section 502, which the cantilevered arm 51 extends from and has a similar width with the cantilevered arm 51. The main body 50 is a substantially "Z" shape to prolong the current route and to cut the area of the immovable contact 5, thereby decreasing the capacitance of the immovable contact 5. The cantilevered arm 51 forms a taper portion 511 in a free end thereof for conveniently inserting the immovable contact 5 into the second groove 215. The cantilevered arm 51 forms an angle with the fixing portion 50. The soldering portion 53 is substantially step-shaped and has a horizontal portion 54 for being soldering to the printed circuit board.

Referring to FIGS. 2–6, in assembly, firstly, the cantilevered beam 42 of the movable contact 4 and the cantilevered arm 51 of the immovable contact 5 are respectively inserted into the first groove 213 and the second groove 215 of the insulative housing 2. Secondly, the movable and immovable contacts 4, 5 are completely inserted into the first and second grooves 212, 213. The stepped-shape soldering portion 45, 53 respectively abut against the corresponding posts 216 of the housing 2 and space from each other. Finally, the metal outer shield 3 is assembled on the housing 2 with the protrusions 231 of the housing 2 engaging with the corresponding notches 311 of the shield 3 and the channels 232 of the housing 2 engaging with the projections 312 of the shield 3.

As depicted in FIG. 7 in conjunction with FIG. 5, in use, the current flows from the movable contact 4 to the immovable contact 5 through the tab 44 of the movable contact 4. Due to the Z shaped fixing portion 50 of the immovable contact 5, the current through the immovable contact 5 will go through a longer route, thereby decreasing the capacity of the immovable contact 5 and further obtaining better transmission preference. In addition, due to the Z-shaped fixing portion 50, the area of immovable contact 5 is relatively small, thereby further impairing the capacity of the immovable contact 5.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for mounting on a printed circuit board, comprising:

a housing defining a receiving cavity;

a metal outer shield assembled on said housing;

an immovable contact retained in the cavity of the housing, said immovable contact having a main body, a cantilevered arm extending from the main body in a forward direction, and a soldering portion extending from said main body and disposed oppositely to the cantilevered arm, said main body defining a slantedly forwardly and downwardly extended open slot below a junction portion between said main body and said cantilevered arm; and a movable contact retained in the cavity of the housing and contactable with said immovable contact.

2. An electrical connector as defined in claim 1, wherein the soldering portion is formed in a stepped shape and comprises a horizontally extended portion for soldering onto said printed circuit board.

3. An electrical connector as defined in claim 1, wherein said main body of the immovable contact forms a retention section for securely retaining said immovable contact in said cavity of said housing.

4. An electrical connector as defined in claim 1, wherein said movable contact comprising a fixing portion, a cantilevered beam and a soldering portion extending oppositely from said fixing portion, and wherein said movable contact forms a tab transversely projecting from said cantilevered beam towards said immovable contact.

5. The electrical connector as claimed in claim 1, wherein said movable contact defines another main body opposite, in a transverse direction, to the main body of the immovable contact in a parallel relation.

6. An electrical connector adapted for mounting on a printed circuit board, comprising:

a housing defining a receiving cavity;

a contact retained in the cavity of the housing, said contact having a main body equipped with retention structures thereon for retaining the contact to the housing, said main body defining opposite front and rear ends thereof, a cantilevered contact arm extending from the front end of the main body in a forward direction for contacting another contact of the complementary connector;

said main body defining essentially a transverse dimension along a transverse direction perpendicular to said front-to-back direction, said transverse dimension being larger than another transverse dimension defined by the cantilevered contact arm so that the main body defines an outward expanded stepped structure on thereof a joint section with regard to the cantilevered contact arm; wherein a slot is defined in the main body so as to form an extension section to be linked to the cantilevered contact arm, and a width of said extension section is similar to the transverse dimension of the cantilevered arm and smaller than the transverse dimension of the main body.

7. The electrical connector as claimed in claim 6, wherein existence of said slot not only decreases an area of the main body but also increases a length of a current path, thus impairing capacity of the contact advantageously.

8. The electrical corrector as claimed in claim 6, wherein the slot extends obliquely relative to the front-to-back direction and said transverse direction.

9. The electrical connector as claimed in claim 6, wherein said slot extends from the front end of the main body.

10. The electrical connector as claimed in claim 6, wherein said slot extends adjacent to a bottom edge of the main body where a solder portion is formed thereabouts.

11. The electrical connector as claimed in claim 6, wherein said cantilevered contact arm is immoveable relative to the housing.

12. The electrical connector as claimed in claim 6, wherein said extension section extends oblique to the front-to-back direction.

13. The electrical connector as claimed in claim 6, wherein said retention structures include two opposite barbs respectively located on upper and bottom edges of the main body.

14. The electrical connector as claimed in claim 6, wherein said main body and said cantilevered arm are located on a same plane.

15. The electrical connector as claimed in claim 6, further including another contact having another main body opposite, in the transverse direction, to the main body of the immoveable contact in a parallel relation.

* * * * *